US007770829B2

(12) United States Patent
Wark

(10) Patent No.: US 7,770,829 B2
(45) Date of Patent: Aug. 10, 2010

(54) METHOD AND APPARATUS FOR PROTECTED COAL MILL JOURNALS

(76) Inventor: Rickey E. Wark, 2 S. Gary Glen Cir., The Woodlands, TX (US) 77382

( * ) Notice: Subject to any disclaimer, the term of this patent is extended or adjusted under 35 U.S.C. 154(b) by 614 days.

(21) Appl. No.: 11/787,736

(22) Filed: Apr. 17, 2007

(65) Prior Publication Data

US 2007/0186400 A1 Aug. 16, 2007

Related U.S. Application Data

(63) Continuation of application No. 10/995,729, filed on Nov. 22, 2004, now abandoned.

(51) Int. Cl.
*B02C 25/00* (2006.01)

(52) U.S. Cl. ..... 241/30; 241/119

(58) Field of Classification Search ..... 241/30, 241/119, 121

See application file for complete search history.

(56) References Cited

U.S. PATENT DOCUMENTS 4,234,132 A * 11/1980 Maliszewski, Jr. ..... 241/53
4,504,018 A 3/1985 Diggins
4,538,768 A * 9/1985 Paskowski et al. ..... 241/101.2
4,602,745 A * 7/1986 Maliszewski et al. ..... 241/119
4,605,174 A * 8/1986 Maliszewski et al. ..... 241/52
4,606,506 A 8/1986 Okada et al.
4,687,145 A 8/1987 Dougan et al.
4,752,037 A * 6/1988 Farris et al. ..... 241/79.1
4,907,751 A * 3/1990 Wark et al. ..... 241/119
5,090,631 A * 2/1992 Wark ..... 241/119
5,386,619 A 2/1995 Wark
5,605,292 A * 2/1997 Bunton ..... 241/79.1
5,873,156 A 2/1999 Wark
5,957,300 A 9/1999 Nardi et al.
7,100,853 B2 * 9/2006 Wark ..... 241/119
7,448,565 B2 * 11/2008 Farris ..... 241/119
2006/0022075 A1 * 2/2006 Wark ..... 241/119
2006/0118673 A1 6/2006 Wark

OTHER PUBLICATIONS

Admitted Prior Art, paragraph 0005 of p. 1 in the specification of the disclosed invention.*

* cited by examiner

*Primary Examiner*—Bena Miller
(74) *Attorney, Agent, or Firm*—Young Basile Hanlon & MacFarlane, PC

(57) ABSTRACT

A method of protecting coal mill journals from abrasive wear due to impingement of coal fines includes the steps of fabricating and attaching a mild steel liner form to the journal and welding wear plates to the liner form. Welding the plates to the form can occur before and/or after the form is attached to the journal. The liner form is made up of plates providing only flat exterior surfaces.

3 Claims, 3 Drawing Sheets

METHOD AND APPARATUS FOR PROTECTED COAL MILL JOURNALS

RELATED APPLICATION

This application is a continuation of U.S. application Ser. No. 10/995,729 filed on Nov. 22, 2004, currently pending. The content of the U.S. patent Ser. No. 10/995,729 is incorporated herein by reference.

FIELD OF THE INVENTION

This invention relates to the protection of coal mill journals from abrasive wear due to the impingement of coal fines carried by an air stream flowing through the coal mill and more particularly to a method and apparatus for of protecting a coal mill journal comprising the steps of attaching a liner form made up of flat surfaces to the journal and covering the flat surfaces with high hardness wear plates.

BACKGROUND

Classifier type coal mills utilize pressure rollers which rotate over the holding surface of a rotating bowl onto which lump coal is fed so as to be crushed by interaction between the rollers and the bowl surface. The rollers are supported by journals having spring suspension systems. The journals and the suspension systems are subject to harsh abrasive wear as a result of the impingement of milled coal carried into contact with the journal and suspension system components by a stream of air which flows upwardly through the mill to perform a classifier function.

In this environment coal mill journals and suspension components wear away in a relatively uneven fashion to create rough outer surfaces and eventually to weaken the structural components to the point where they must be replaced.

In the past it has been common to protect the journal and associated components by welding custom cut wear plates to the eroded surfaces of the journal and suspension housings. Because each journal housing wears in a somewhat different fashion, liner wear plates have to be cut and fit in a laborious fashion. The attachment process is made more difficult by the fact that most journal housing surfaces are curved whereas the wear plates are cut from larger plates which are entirely flat. In many cases, the journal is so severely worn that insufficient material remains to level off the surface without further weakening it. The result is high expense in the process of attaching the wear materials and, in many cases, premature replacement of journal components.

SUMMARY OF THE INVENTION

The present invention facilitates the protection of coal mill journals and associated suspension housings with high hardness wear materials by providing a liner form which essentially covers a journal to the extent needed to intercept impinging milled coal carried in an airstream and provides further advantage in offering exclusively flat contiguous outer surfaces to which high hardness wear plates are readily attached by processes such as welding. The liner form preferably has peripheral edges which are contoured to conform to the external configuration of the journal; for example, the partial enclosure defined by an illustrative liner form has a flat front surface with an arcuate cut-out which conforms to the cylindrical surface of a journal housing so as to permit the liner form to be attached such as by welding to the journal housing.

In accordance with the present invention, the wear materials may be attached to the liner form before or after it is installed on the journal, the overall result of protecting the journal and suspension components from excessive wear being achieved in either case. Once the journal liner form is installed, the wear plates on it may be replaced several times either individually or in groups.

In accordance with the preferred form of the invention, the liner form is made of flat half-inch mild steel plates welded together to create a form with all flat major surfaces. This simple design allows for the easy creation and attachment of flat wear plate components made, for example, from SA1750CR chromium carbide. Other equivalent materials include cast alloys, and ceramics with alumina filler. It has been found that the journal liner structure of the present invention not only protects the journal from wear but adds to its overall structural strength as well. It has also been found that the liner of the present invention may be installed over previously repaired areas even though such areas present highly irregular exterior surfaces.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 2:
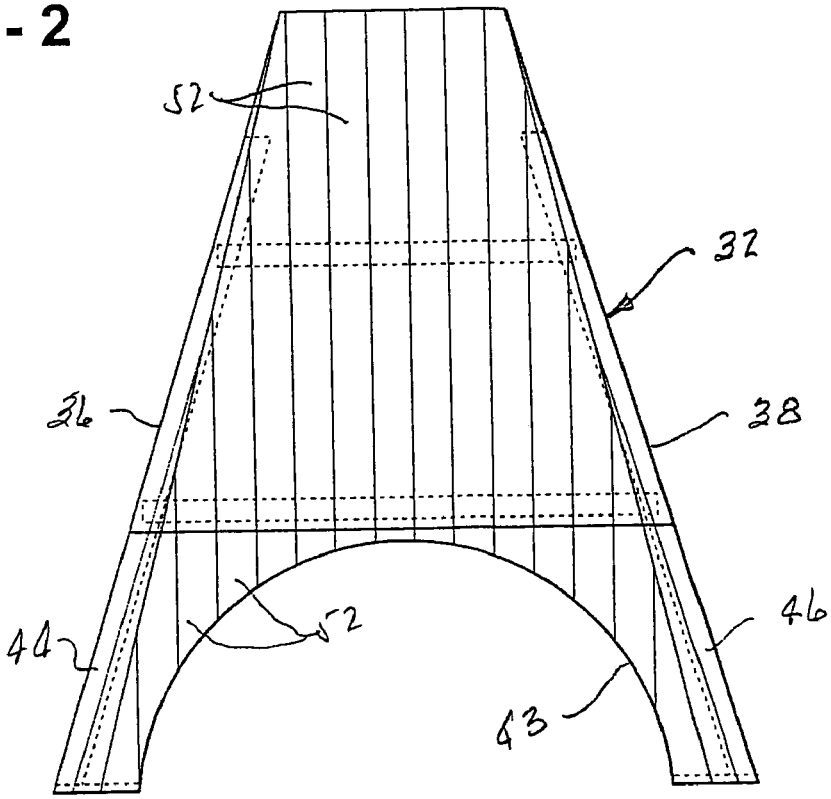
FIG. 2 is a front view of a journal liner constructed in accordance with the present invention.
Figure 3:
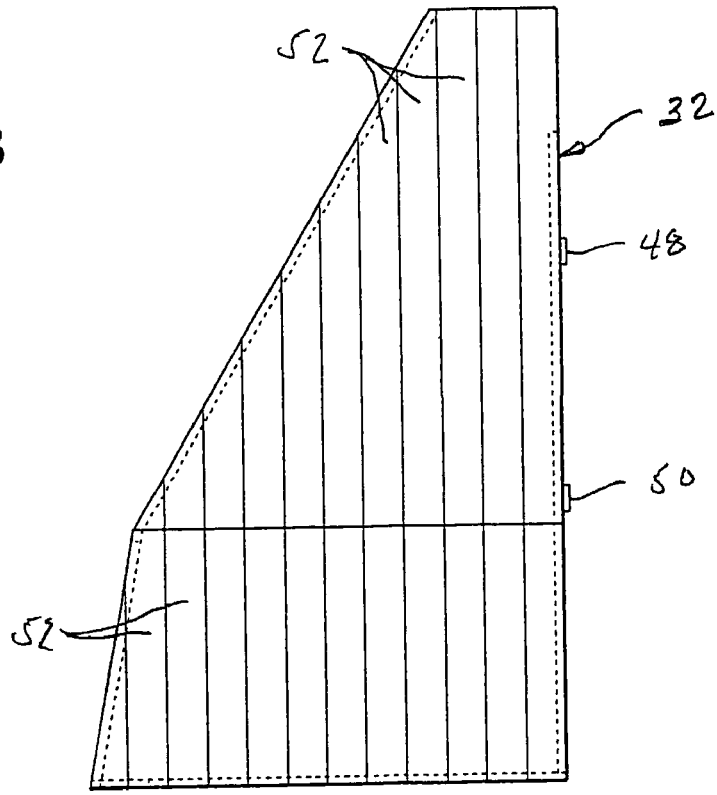
FIG. 3 is a side view of the journal liner of FIG. 2.
Figure 4:
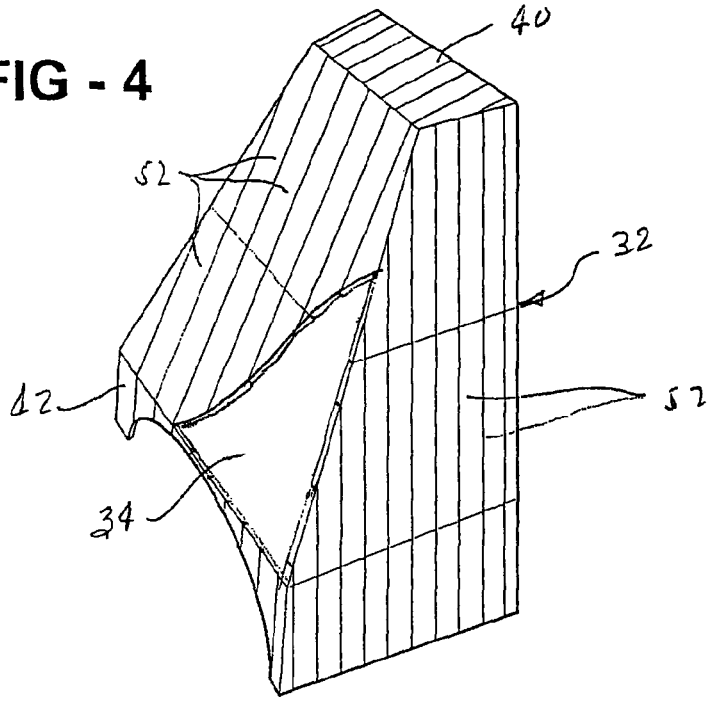
FIG. 4 is a perspective view with a portion of the wear plate liner broken away, of the liner form of FIG. 2

Referring to FIG. 2, a representative coal mill/classifier as shown comprises a large steel cylindrical housing 10 within which a pulverizer bowl 12 is mounted for rotation about a vertical axis. The bowl 12 receives lump coal through a loading chute 14 and a feed pipe 16. A vane wheel 18 is attached to the bowl 12 around the outer periphery thereof and rotates with the bowl about the vertical axis. A surrounding structure 20 and a stationary deflector 21 control air flow in a known manner. Tapered rollers 22 are mounted within the mill 10 so as to crush the lump coal fed to the bowl 12 as the bowl rotates about the vertical axis. The contact surfaces of the rollers 22 rotate on axles 21 extending through journal housings 24 into a radially enlarged portion 26 of the housing 10. Compression spring type suspension units 28 are mounted to the housing portion 26 above and in parallel to the journal axes and are mechanically engaged with radial arms 25 to permit the rollers 22 and journal assemblies associated therewith to pivot about an axis defined by mechanism 29 shown in FIG. 5. This allows the rollers 22 to lift off the contact surface of the bowl 12 to accommodate particularly large or hard lumps of coal or other foreign objects which may come between the surfaces of the rollers 22 and the bowl 12. At the same time the compression springs in the suspension units 28 urge the rollers 22 into firm contact with the bowl thereby to efficiently perform the crushing action.

The operation of the rollers 22 and the vane wheel 18 is such as to create an upward flowing air stream within the housing 10 which, as will be apparent for those knowledgeable about coal mill/classifiers, carries the coal fines upwardly to and through discharge chutes 30 which feed one or more combustion chambers for turbine boilers. This upward flow of coal fines is instrumental in eroding unprotected surfaces of the journal housing 24 and suspension arms connected between the journal housing 24 and the inner end of the suspension mechanisms 28.

Figure 1:
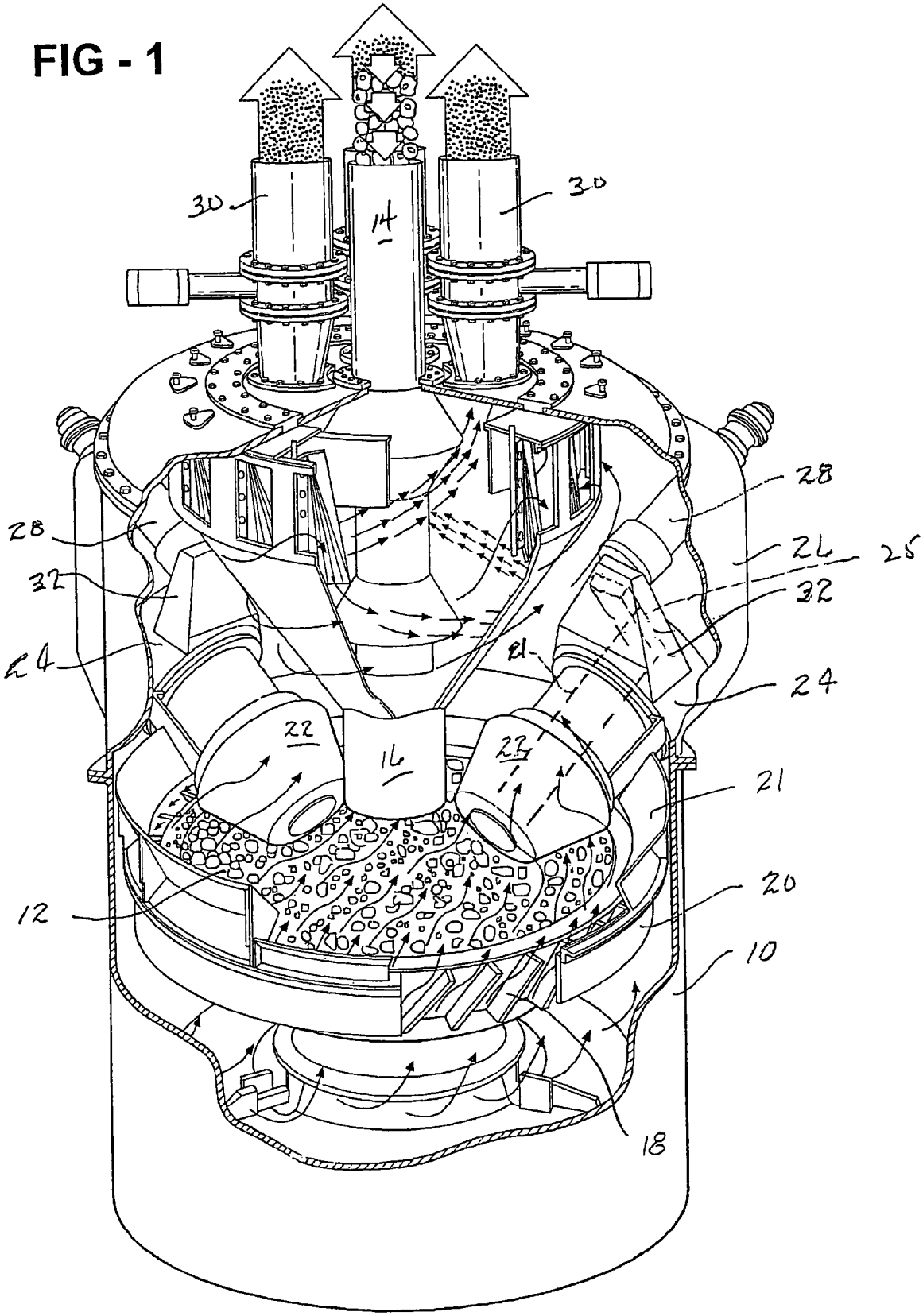
FIG. 1 is a cross sectional perspective view of a representative coal mill embodying one form of the invention.
Figure 5:
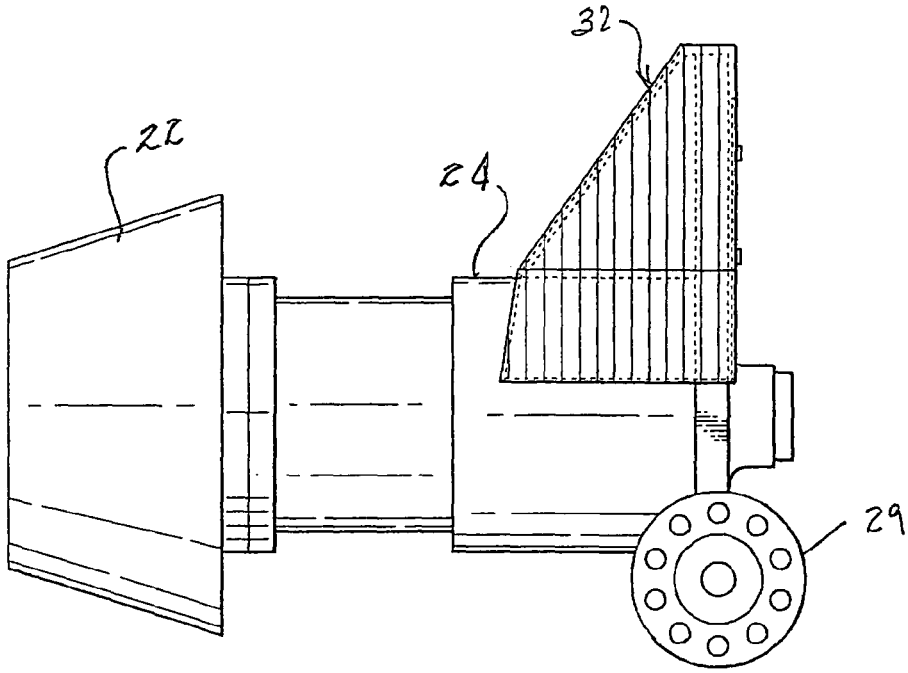
FIG. 5 is a side view of an installed journal liner from the coal mill of FIG. 1.

To deal with this problem, the present invention employs generally triangular mild steel liner forms 32 mounted on the journals 24 to protect the radial suspension arm 25 and journal surfaces from erosion due to impingement by the upwardly flowing coal fines. As shown in FIGS. 2-5 the mild steel forms 32 are constructed entirely of flat plates which are cut to the desired shape and size and welded together along the edges. Each liner form comprises a flat front plate 34, side plates 36 and 38, a top plate 40 and a lower front plate 42 having an arcuate cut out 43 which matches the radius of the journal housing 24 so as to sit in close abutting relationship thereover when installed as shown in FIGS. 1 and 5. The back of the liner form 32 is open but preferably has side and bottom flanges of approximately one-inch depth as shown by the dotted lines in FIG. 2, together with back straps 48 and 50 welded across the side flanges for rigidity as shown.

High hardness chromium steel wear plates 52 are attached such as by welding to the flat exterior surfaces of the liner form 32 as shown in FIGS. 2-5. The attachment procedure and mechanism may take various forms; for example if the wear plates 52 are welded to the mild steel form 32 before the form is installed on the journal housing 24, it is possible to weld them to the form from the inside. This is achieved by burning one or more holes in the liner form neatly under each of the wear plates 52 and then welding the form to the plate from the inside. It is more likely, however, that the wear plates 52 are welded to the form 32 from the outside so as to create greater latitude with respect to when the wear plates 52 are attached as well as to permit the wear plates 52 to be replaced from time to time over the life of the journal protecting form 32. In short, attachment of the plates 52 to the form 32 after mounting the form on the journal is the preferred mode.

Figure 6:
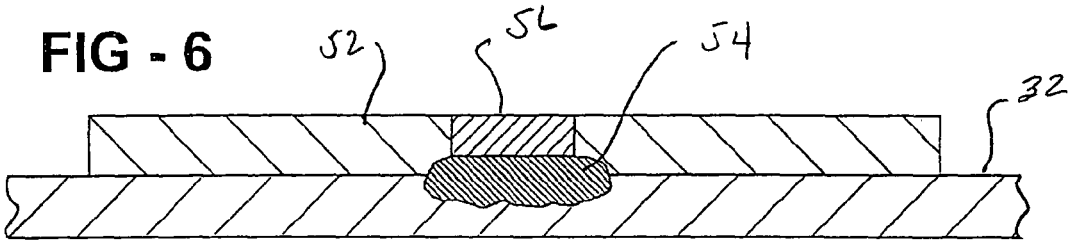
FIG. 6 is a cross section of a weld area showing how a wear plate is welded to the liner form of FIG. 2.

To this end a hole is burned in the wear plate 52 as shown in FIG. 6 and a weld 54 is formed to attach the wear plate 52 to the liner form 32. Thereafter a hardened steel plug 56 is set in place to protect the weld. The plug 56 may be carefully shaped and simply hammered into place.

Whether or not the wear plates 52 are attached before or after installation, it is necessary to seat the liner form 32 on the journal housing 24 so that the arcuate cut out 43 rests on and conforms to the curvature of the journal housing 24. Thereafter a linear weld is applied along the seam between the cut out 43 and the journal housing 24. The open back of the liner form 32 is of no consequence since any coal fines which may find there way in and through the back of the form have insufficient kinetic energy to create a significant erosion when contacting the unprotected metal of the journal housing 24 and/or the suspension arm. The liner form of the high hardness wear plates fully protects not only the critical upper surface of the journal housing 24 but the entirety of the radial suspension arm which lies within the liner form.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A method of protecting the suspension components of a coal mill of the type having a generally cylindrical housing having a sidewall, a milling bowl within the housing and adapted to rotate about a vertical axis of rotation, at least one crusher roller contacting the bowl and having an axle which extends at an angle relative to said vertical axis, a journal housing enclosing said axle, a cylindrical outer surface on said journal housing, a spring unit mounted to said sidewall above and parallel to said axle and extending through said sidewall, and an arm connected between the journal and said spring so as to bias the roller against the bowl wherein the method comprises the steps of:

attaching an open back, metal liner having an exterior surface made up entirely of flat contiguous and intersecting surfaces to the journal housing so as to cover said arm and at least a portion of said spring unit.

2. A method as defined in claim 1 where the liner form has at least one peripheral edge contoured to conform to the external configuration of the journal housing and the step of attaching includes resting the liner form on the journal housing such that the peripheral edge rests on and conforms to the external configuration of the journal housing.

3. A method defined in claim 1 including the further step of covering the outer surfaces of the liner form with high hardness wear plates.

* * * * *